US006709325B2

(12) United States Patent
Korsen

(10) Patent No.: US 6,709,325 B2
(45) Date of Patent: Mar. 23, 2004

(54) TUBE FOR HOLDING COINS

(76) Inventor: Jack Korsen, 10736 Jefferson Blvd., #433, Culver City, CA (US) 90230

( * ) Notice: Subject to any disclaimer, the term of this patent is extended or adjusted under 35 U.S.C. 154(b) by 92 days.

(21) Appl. No.: 10/085,521

(22) Filed: Feb. 27, 2002

(65) Prior Publication Data

US 2003/0162489 A1 Aug. 28, 2003

(51) Int. Cl.[7] ..... G07D 9/06
(52) U.S. Cl. ..... 453/61; 206/0.8; 206/0.82
(58) Field of Search ..... 453/61, 63; 220/315; 232/1 D, 55; 206/403, 404, 0.8, 0.82, 445

(56) References Cited

U.S. PATENT DOCUMENTS 2,808,925 A * 10/1957 O'Rielly ..... 206/0.82
3,244,272 A * 4/1966 Beaman et al. ..... 206/0.82
3,252,568 A * 5/1966 Steidinger ..... 206/403
3,312,336 A * 4/1967 Fally ..... 206/0.82
3,346,109 A * 10/1967 Duran ..... 453/60
4,010,845 A * 3/1977 Bloomfield ..... 206/0.82

FOREIGN PATENT DOCUMENTS

DE 37.208.810 A1 * 2/1988 ..... B65D/1/36

* cited by examiner

*Primary Examiner*—Donald P. Walsh
*Assistant Examiner*—Mark J Beauchaine
(74) *Attorney, Agent, or Firm*—Louis J. Bovasso; Greenberg Traurig, LLP

(57) ABSTRACT

A tube for holding coins wrapped in a paper wrapping in a tight close-fitting relationship. The tube is square shaped having a main body portion with an inner chamber for holding the wrapped coins and a removable cap tightly fitting to the main body portion. The chamber extends upwardly from the main body portion terminating in an annular lip which engages an inner annular ridge on the cap. Both the cap and the main body portion having longitudinally extending ribs at the corners, the ribs of the main body portion having depressions at top receiving nubs on the ribs of the cap thereon to prevent the cap from turning with respect to the main body portion.

11 Claims, 2 Drawing Sheets

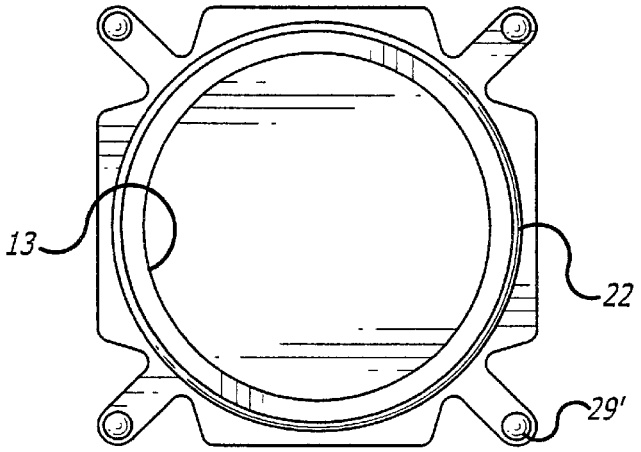
FIG. 3
FIG. 4
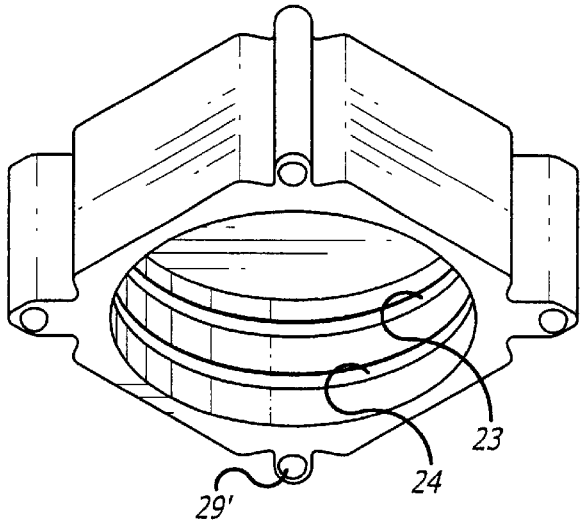
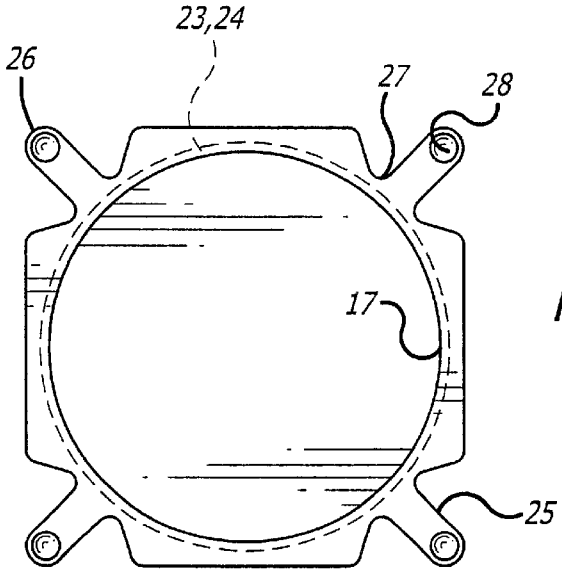
FIG. 5

TUBE FOR HOLDING COINS

BACKGROUND OF THE INVENTION

1. Field of the Invention

The invention relates to coin tubes; and, more particularly, to a closable tube for holding a wrapped set of coins in tight fitting relationship.

2. Related Art

Coin tubes are tubes for holding a fixed number of coins of a certain denomination in a container. In the past, such tubes were cylindrical but in U.S. Pat. No. 3,244,272, to Beaman et al., a rectangular coin tube is disclosed. These tubes improved on prior art cylindrical tubes by being stackable and non-rolling when placed on a supporting surface. Such tubes may be used by collectors and should be transparent or semi-transparent so as to be able to inspect the coins therein and air tight to preserve the coins against corrosion and oxidation.

The coin tube in U.S. Pat. No. 3,244,272 solves most of these problems but has a removable cap that is not fixed to the tube's main body. Although lugs are disclosed on the exterior of the tube of the main body portion which engage grooves on the interior of the cap, it is expensive to manufacture such lugs and grooves to provide proper alignment. They also do not provide a positive locking feature on the cap.

Also, the exterior rectangular surfaces of the main body portion of the coin tube are flat and planar with sharp corners. Such tubes can still easily roll on a supporting surface.

There is a need for a coin tube that is less expensive to make than known prior art tubes, is stackable, uses less material than prior art tubes and does not roll when placed on a supporting surface. The cap should be locked to the tube body to prevent the cap from coming off and the contents of the tube from coming out.

SUMMARY OF THE INVENTION

It is an object of this invention to provide a coin tube having interlocking means at the mating corners of the removable cap and main body portion to prevent the cap from spinning or sliding off, with respect to the main body portion.

It is a further object of this invention to provide aligned ribs at the corners of the removable cap and main body portion to reduce the costs of manufacture of the coin tube and give vertical strength to the tube.

These and other objects are preferably accomplished by providing a square shaped coin tube having a main body portion with an inner chamber for holding the wrapped coins and a removable cap tightly fitting to the main body portion. The chamber extends upwardly from the main body portion terminating in an annular lip which engages one or more inner annular ridges on the cap. Both the cap and the main body portion having longitudinally extending ribs at the corners, the ribs of the main body portion having depressions at top receiving nubs on the ribs of the cap thereon to prevent the cap from turning with respect to the main body portion.

BRIEF DESCRIPTION OF THE DRAWINGS

FIG. 3 is a view of the underside of the cap of FIG. 1 taken along lines 3—3 thereof;

FIG. 4 is a perspective view of the underside of the cap of FIG. 1; and

FIG. 5 is a view taken along lines 5—5 of FIG. 1.

DESCRIPTION OF THE PREFERRED EMBODIMENT

Figure 1:
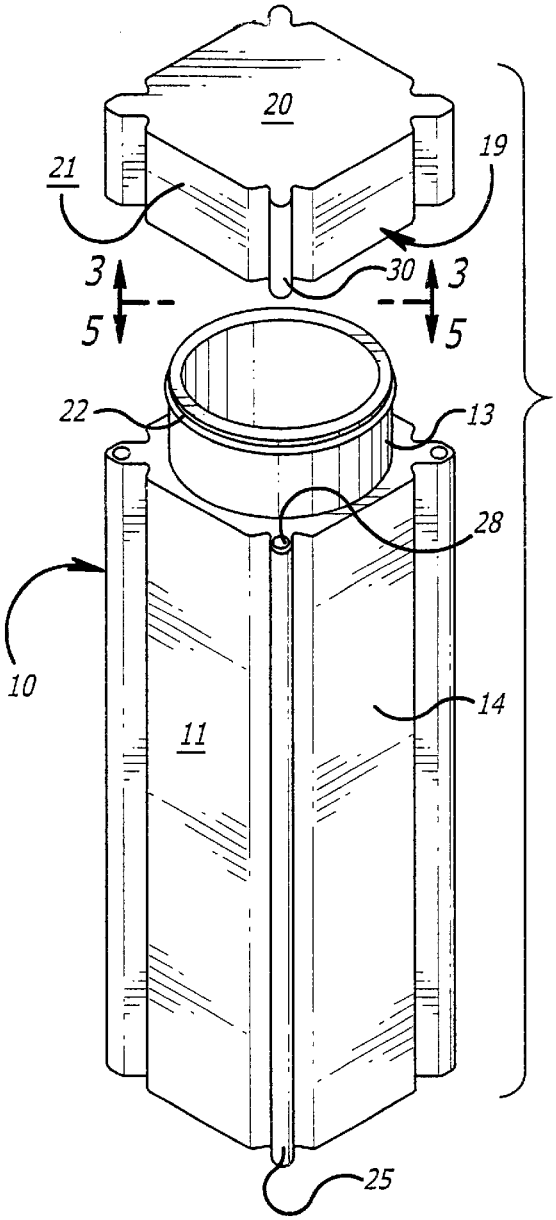
FIG. 1 is an exploded perspective view of a coin tube in accordance with the teachings of the invention.
Figure 2:
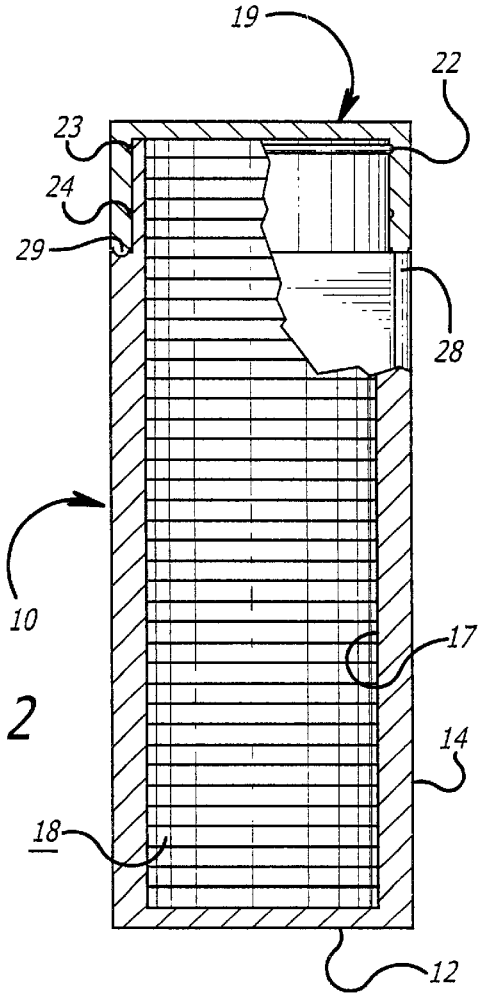
FIG. 2 is an elevational sectional view illustrating the interlocking features of the cap and main body portion of the tube of FIG. 1.

Referring now to FIG. 1 of the drawing, a coin tube 10 is shown having four generally rectangular planar sides 11 forming a lower main body portion 14 with a square-shaped bottom 12 (FIG. 2). Tube 10 has a generally cylindrical cap receiving portion 13 (FIG. 1) at top slightly lesser in diameter than the width of main body portion 14. Cap receiving portion 13 has a ridge 22, on its exterior at top for reasons to be discussed.

Coin tube 10, as shown in FIG. 2, is adapted to receive in its interior 17 a plurality of coins 18 which may be wrapped in a paper wrapper (not shown) or unwrapped (as shown).

A removable cap 19 (FIG. 1) is provided which is generally square in cross-section having a top wall 20 and 4 interconnected side walls 21. As seen in FIG. 2, cap 19 is hollow on its interior, which is round, as seen in FIG. 3, and has a plurality, such as 2, of spaced ridges 23, 24 (see FIG. 4) to compensate for caps that might be slightly larger than the outer configuration of portion 13 to provide a tight friction fit with cylindrical portion 13.

As seen in FIG. 1, each corner of main body portion 14 has an elongated rib 25, which, as seen in FIG. 5, is generally rounded at its end 26, and extends outwardly from main body portion 14 with cut out areas 27, 29 on each side thereof.

Each rib 25 terminates at top in a hole or depression 28 (see also FIGS. 1 and 2) which receives therein a nub 29' (FIG. 4) in cap 19. As also seen in FIGS. 1, 4 and 3, the cap 19 has 4 ribs 30 at each corner identical to ribs 25 on main body portion 14 so as to provide an extension thereof.

In operation, coins 18 are placed inside of the main body portion 14 of tube 10 and such coins 18 are either sufficient in number to extend to the top of cylindrical portion 13 (as seen in FIG. 2) or wrapped in a coin wrapper to friction fit therein.

Cap 19 is now placed on top of cylindrical portion 13, ridge 22 moving over ridges 23, 24 inside of cap 19, the latter providing a friction fit of cap 19 thereon. Nubs 29' on cap 19 snap into the holes or depressions 28 on main body portion 14 thus preventing cap 19 from rotating with respect to main body portion 14. Of course, nubs 29' could be on main body portion 14 and mate with holes or depressions 28 in cap 19.

The outer configuration of coin tube 10 and ribs 25 prevents it from rolling and such tubes can be easily stacked. The configuration herein uses less material in the manufacturing process than known coin tubes. The nubs and holes 28, 29 provide a firm lock of the cap 19 to the main body portion of the tube. The ridges 23, 24 inside of the cap 19 provide for any misalignment in the manufacturing process between the inner circular configuration of cap 19 and the outer cylindrical configuration of cylindrical portion 3 thus saving costs of tooling in the manufacture thereof.

Any suitable materials may be used, such as plastic, and such material should preferably be transparent or semi-transparent so as to be able to view the inner contents of the coin tube 10 without the need of removing cap 19. Preferably, the material used should be an inert material, such as polypropylene or polyethylene so as not to harm, tarnish or chemically react with the coins in the tube.

The coin tube 10 disclosed herein is cheaper to manufacture, uses less materials and provides an air tight seal for the stored coins that is an improvement over prior art coin tubes. There is a positive lock of the cap to the tube body to prevent the cap from coming off and the contents from coming out. Rings 23, 24 provide a semi-locking feature to the cap so that, if the tube is dropped, the contents will not spill out.

Any suitable dimensions can be used. For example, cylindrical portion 13 may be about 1.054 inches in outer diameter and about 1.040 inches in inner diameter. Main body portion 14 may be about 1.070 inches in outer diameter and about 2.414 inches in length. Cylindrical portion 13 may be about 0.500 inches in length with ridge 22 spaced from the upper end of cylindrical portion 13 about 0.100 inches. Ridge 22 may be about 0.020 inches wide. Ribs 25, 30 may be about 0.100 inches wide.

It can be seen that there is disclosed a coin tube that is designed to prevent the tube from rolling. It can be manufactured using less materials than prior art coin tubes and lesser attention to tolerances. The unique nub and hole arrangement between the cap and cylindrical portion keeps the cap from spinning and coming off. The coin tube is stackable and the ridges on the interior of the cap compensate for misalignment providing a tight friction fit. The contents of the tube are protected and will not fall out if the tube is dropped.

Although a particular embodiment of the invention is disclosed, variations thereof may occur to an artisan and the scope of the invention should only be limited by the scope of the appended claims.

I claim:

1. A coin tube comprising:

a main body portion generally rectangular in cross-section having four elongated generally rectangular sides meeting at four corners thereof, a bottom wall, and a generally cylindrical portion of the upper end thereof integral therewith having an outer diameter less than the outer diameter of said main body portion; and a cap generally rectangular in outer configuration having an inner generally cylindrical wall friction fit on to said cylindrical portion, said cap having 4 side walls meeting at four corners thereof, said corners of said cap and said main body portion having mating nubs and holes fixedly securing said cap to said main body portion in a non-rotating manner.

2. The tube of claim 1 wherein said nubs are on said cap and said holes are on said main body portion.

3. The tube of claim 1 wherein each of said corners of said cap and said main body portion includes aligned elongated ribs.

4. The tube of claim 3 wherein said ribs extend outwardly from said main body portion and said cap respectfully terminating in generally rounded ends with elongated grooves on each side thereof forming said ribs.

5. The tube of claim 1 wherein said cylindrical portion has an annular ridge on the exterior thereof adjacent the upper end thereof spaced from said main body portion.

6. The tube of claim 1 wherein said cap has a plurality of spaced ridges on the interior of said cylindrical wall to provide for a friction fit between said cap and said cylindrical portion.

7. The tube of claim 1 wherein said main body portion and said cylindrical portion are formed from one piece of plastic material.

8. The tube of claim 7 wherein said cap is formed from one piece of plastic material.

9. The tube of claim 8 wherein said cap, said main body portion and said cylindrical portion are of a semi-transparent material.

10. The tube of claim 9 wherein said cap, said main body portion and said cylindrical portion are of polypropylene.

11. The tube of claim 9 wherein said cap, said main body portion and said cylindrical portion are of polyethylene.

* * * * *